350-314

12/29/81 XR 4,307,899

United States Patent [19]

Hoppe

[11] 4,307,899

[45] Dec. 29, 1981

[54] IDENTIFICATION CARD WITH HALLMARKS ADAPTED TO BE INSPECTED BY TRANSMITTED AND INCIDENT LIGHT AND A PROCESS FOR THE PRODUCTION THEREOF

[75] Inventor: Joachim Hoppe, Munich, Fed. Rep. of Germany

[73] Assignee: GAO Gesellschaft fur Automation & Organisation mbH, Munich, Fed. Rep. of Germany

[21] Appl. No.: 81,704

[22] Filed: Oct. 4, 1979

[30] Foreign Application Priority Data

Jan. 12, 1979 [DE] Fed. Rep. of Germany ..... 2901150

[51] Int. Cl.[3] ..... B42D 15/02; G09F 3/02

[52] U.S. Cl. ..... 283/7; 40/2.2; 283/8 R; 350/314; 350/316

[58] Field of Search ..... 283/7, 8 R, 9 R; 40/2.2, 559, 560, 561, 564, 442; 427/7, 164, 265, 288; 235/380, 491; 350/314, 316

[56] References Cited

U.S. PATENT DOCUMENTS

| | | | |
|---|---|---|---|
| 2,110,500 | 3/1938 | Chiera | 350/314 X |
| 2,506,153 | 5/1950 | Hurley | 350/314 X |
| 3,414,998 | 12/1968 | Berger | 40/2.2 |
| 3,802,101 | 4/1974 | Scantlin | 40/2.2 |
| 4,124,947 | 11/1978 | Kuhl | 283/8 R X |

FOREIGN PATENT DOCUMENTS

| | | |
|---|---|---|
| 2901150 | 12/1979 | Fed. Rep. of Germany . |
| 406933 | 3/1934 | United Kingdom . |
| 565708 | 11/1944 | United Kingdom . |
| 704775 | 3/1954 | United Kingdom . |
| 1249754 | 10/1971 | United Kingdom . |
| 1427581 | 3/1976 | United Kingdom . |

*Primary Examiner*—Paul A. Bell
*Assistant Examiner*—John S. Brown
*Attorney, Agent, or Firm*—Neuman, Williams, Anderson & Olson

[57] ABSTRACT

A hallmark for example for a solid plastic identification card consisting of a plurality of layers is described. The hallmark is formed by means of only partially overlapping color coatings on a monochromatic or monochromatically printed substrate foil. More plastic foils are laminated onto the substrate foil, if desired. Single-layer printed portions of the surface appear bright in transmitted light and dark in incident light; multi-layer printed portions of the surface appear dark in transmitted light and bright in incident light, thus producing a watermark-like effect.

18 Claims, 4 Drawing Figures

IDENTIFICATION CARD WITH HALLMARKS ADAPTED TO BE INSPECTED BY TRANSMITTED AND INCIDENT LIGHT AND A PROCESS FOR THE PRODUCTION THEREOF

BACKGROUND OF THE INVENTION

This invention relates to an identification card with hallmarks adapted to be inspected by transmitted and incident light, said identification card consisting of a sheet-like substrate, if desired, with a plurality of layers laminated thereupon.

DESCRIPTION OF THE PRIOR ART

It is already known, in particular from the technical field involved with the printing of securities, to provide these securities with hallmarks, e.g. watermarks, in order to protect them from being forged and counterfeited. Watermarks are formed during the sheet formation process of the paper, i.e. when the sheet is formed either during the production of hand-made paper or in the cylinder machine. The watermarks are formed by providing the screen with a relief-type model in the hallmark area so that due to the existing raised and recessed features the thickness of the sheet at the corresponding locations is in some cases greater and in some cases less than the average basis weight. The result is an image which in transmitted light appears to have lighter and darker shadows, thus giving it a plastic effect. If viewed with incident light, this light/dark effect is reversed. Arbitrary half-tones can be achieved depending on the fiber concentration and sheet thickness in the watermark area.

The watermark is extraordinarily significant as a hallmark for securities by virtue of the fact that it is easy to inspect on the one hand and, on the other hand, because a high technical expenditure is required to produce a watermark. Frequently, in the case of papers for the production of bank notes, checks, stock and the like, the entire surface is covered with watermark patterns.

It is also known that many methods exist by which such watermark-like effects can be achieved, but which have only some of the properties of a watermark produced during sheet formation. Hence, compared to such watermarks, they are very inferior and relatively easy to differentiate from the true, integral watermarks.

In the field concerned with the production of products which are to be protected from forgery or counterfeiting, plastics have very recently come into use to an ever increasing extent. Identification cards are already known, for instance, which consist either completely of plastic or in which a paper inlay is laminated between two or more plastic foils. When a paper inlay is employed, this bears the hallmarks such as a true watermark. In the case of so-called solid plastic laminates, i.e. identification cards consisting of a plurality of laminated plastic foils, the use of watermarks is by nature impossible. Hence, one had to be content using other, different features such as a surface imprint, surface relief or magnetic inclusions, for instance.

In spite of an increase in the general production expenditure of the indentification cards by including such features—thus also enhancing the reliability against forgery—it was on the one hand still relatively easy to imitate such features and, on the other hand, it is normally impossible to inspect them by visual means. Thus, there has hitherto been no known process suitable for practical use nor no known technique for producing features in solid plastic laminates which necessitate a certain technical expenditure and whose optical properties permit visual authenticity inspection in transmitted and incident light.

SUMMARY OF THE INVENTION

It is the object of the invention to provide an identification card with hallmarks adapted to be inspected by transmitted and incident light as well as a process for creating such hallmarks which necessitates a certain technical expenditure and which can be applied to plastic substrates as well.

This object is accomplished in accordance with the invention in that the monochromatic or monochromatically printed substrate is printed over a large area and in part with at least partially overlapping, two-dimensional areas. The substrate is preferably a transparent plastic foil or even a plastic foil which has already been homogeneously dyed. Owing to the color coating which overlaps only in part, arbitrarily graduated optical effects are possible in which, in spite of a homogeneous appearance, the areas which are brightest when viewed by transmitted light are brighter than the general surrounding areas and the darkest areas appear darker than the surrounding hallmark areas.

In particular, when employing the inventive markings outside of multilayered laminates, a final homogeneous color layer is preferably provided which covers the entire printed layer structure. Due to the homogeneous uppermost color layer, the underlying hallmark area becomes almost invisible when viewed by incident light. This effect can be varied as desired by varying the thickness or color density of the uppermost printed coating.

In accordance with an advantageous embodiment of the invention, a large area of the substrate, which can be a transparent plastic foil, for instance, is initially printed thinly and subsequently overprinted a second time, those portions of the surface which are to appear lighter in transmitted light compared to the surrounding area being omitted. Then another color coating is applied over the first and second layers in those areas in which dark effects are to be achieved in transmitted light. Three different gray halftone values can be produced in this way with a superimposed arrangement of three layers which overlap only in part. An almost arbitrary further graduation of the gray halftone values can be achieved by additional color coatings which are superimposed on one another in such a way as to overlap in whole or in part.

Thus, a light/shadow effect is produced which has an esthetic appearance in incident light and which reverses when viewed by transmitted light. The artistic design is of course unlimited and arbitrary designs are possible.

The protection against forgery is enhanced if part of the color coatings located between the uppermost and lowermost layers is colored. Images of contrasting color can thus be produced in transmitted light which appear to be almost monochromatic when viewed in incident light. If all color coatings are chosen to be white, however, the sole effect obtained will be a hallmark with modulated pure gray graduations.

In order to produce halftones or gray tones or even graduated contrasting colors, the color coatings vary in thickness. The same effect can be achieved by selectively varying the number of layers which are printed one above the other or by accordingly adjusting the body of the colorant used in the printed coating.

The inventive hallmarks can be produced in principle by all common printing methods such as offset printing, letterpress printing or the like.

Preferably, however, the colorant is printed by the silk screen process. In this process, an increase in the layer thickness can be attained by correspondingly enlarging the silk screen mesh. The mesh also imparts to the color coating a certain structure which constitutes an auxiliary artistic element.

According to a further development of the invention, one or, if desired, more plastic foils are laminated onto the substrate after this has been printed. In this way, for example, solid plastic identification cards can be manufactured which have hallmarks which can be used to visually inspect the authenticity of the identification card.

The body of the printing ink or colors can be consciously regulated by mixing the printing ink or colors with substances persons skilled in the art term transparent pastes. This procedure permits halftones and color graduations to be obtained without having at the same time to vary the layer thickness accordingly. Since in silk screening it is substantially impossible to vary the layer thickness without varying the mesh width, this renders silk screening less expensive for industrial production. The forger, however, cannot gain any advantage from this simplification due to the different mixing ratios of the printing inks required in this case.

In particular, when using printing inks whose body has been reduced greatly as well as in the processing of different layer thicknesses, an auxiliary artistic effect can be achieved, since the layers with a high transparent concentration produce an especially plastic effect.

Moreover, in addition to the already existant effects in transmitted and incident light, automatically inspectable hallmarks can be simultaneously provided in the hallmark area by using special printing inks with special physical properties such as fluorescence, specific spectral absorption or the like, for example. Such automatically inspectable hallmarks will provide information about the authenticity of the respective document when it is suitably scanned, even in automatic inspection devices.

In summary, the invention recites a process which for the first time makes it possible to integrate inspection hallmarks into solid plastic laminates in the form of authenticity hallmarks which can be inspected in transmitted and incident light, thereby rendering these solid plastic laminates suitable for examination both visually and automatically.

BRIEF DESCRIPTION OF THE DRAWING

Embodiments of the invention will now be described in the following by way of example with reference to the enclosed drawing, in which.

DESCRIPTION OF THE PREFERRED EMBODIMENTS

Figure 1A:
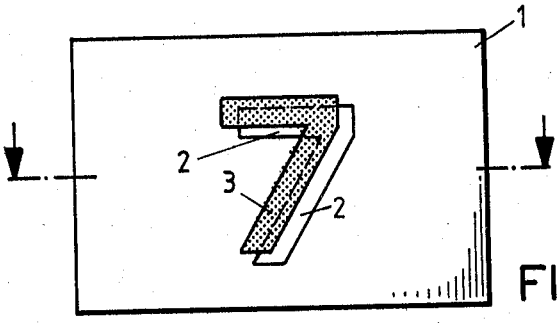
FIG. 1A shows the embodiment of an identification card embodying a hallmark consisting of three layers.
Figure 1B:
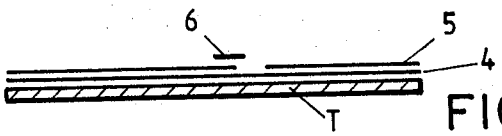
FIG. 1B shows a schematic cross section through the identification card.

The solid plastic identification card shown in FIGS. 1A and 1B has a transparent plastic foil T as the substrate and is printed with a homogeneous layer 4. Two other printed layers 5 and 6 are located above the homogeneous printed layer 4. The layer 5 also extends over the entire substrate T, but includes a cut-out portion shaped like the FIG. "7". The layer 6, which is preferably designed to be somewhat thicker or to have more body, has the shape of the FIG. "7" and is positioned slightly offset with respect to the cut-out portion of layer 5 such that portions of layer 6 project into the cut-out portion of layer 5. Three surface areas 1, 2 and 3 can thus be differentiated due to the printed layers which are positioned above one another in this manner. Two thin white color coatings are positioned above one another in surface area 1. In surface area 2, the substrate T is covered by only one color layer, while in surface area 3 substantially three color layers are superimposed. When viewed in transmitted light, therefore, area 3 appears to be dark due to the absorption effect of the three layers, area 2 light and area 1 semidark. If white colors are used exclusively, this corresponds to a white/medium gray/dark gray graduation. When viewed in incident light, this light/dark effect is reversed, area 3 appearing light, area 2 dark and area 1 semidark. If white is used exclusively, the corresponding gray graduations will result.

During production, the layers are printed on the substrate in their proper sequence and are thereafter laminated or covered with a cover foil (not shown).

Figure 2A:
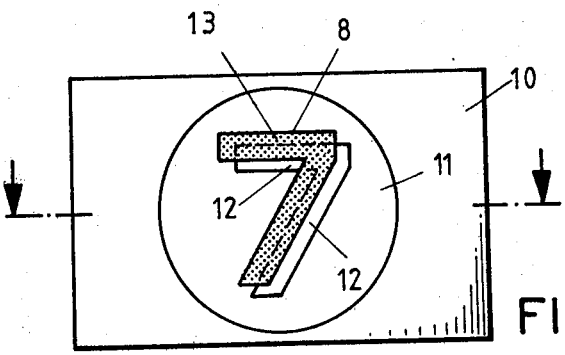
FIG. 2A shows another embodiment of an identification card incorporating a hallmark consisting of four layers.
Figure 2B:
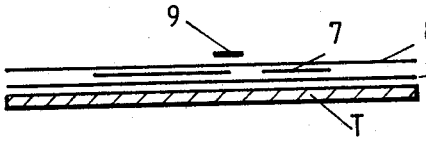
FIG. 2B shows a schematic cross section through the second embodiment of the identification card.

In the embodiment according to FIGS. 2A and 2B, a thin white color layer 4 is initially applied to the transparent substrate foil T as well. Thereafter, an oval print 7 with a red color is applied which, however, covers the entire surface only in part. In this color layer, the contours of a specific figure, again the FIG. "7" in the illustrated embodiment, are cut out. Another thin white color layer 8 is then printed over the entire surface and on top of the red color layer and, finally, a color layer 9 is applied in thick, white color (ink) in the form of the contour of the specific figure, i.e. the FIG. "7" in this case. The result produced is surface areas 10 to 13 which show the following brightness values when examined with transmitted light. Area 10 appears semidark or white. Area 11 appears red, area 12 light or white in the red field and area 13 dark or gray. When viewed with incident light, area 13 appears white and areas 10, 11, 12 exhibit gray graduations ranging from light gray to dark gray. No noticeable red coloring of the area 11 is noticed in incident light due to the body of the color layer 8.

It is self-evident that a correspondingly dyed foil or even a paper layer can be employed instead of the substrate and the first continuous white print.

By using special silk screening inks with special physical properties such as fluorescence, specific spectral absorption or the like, for example, in the production of one or more of the color layers, automatically inspectable hallmarks can be integrated into the hallmark area or into the surrounding area in addition to the already existing incident and transmitted light effects. When suitably scanned, these automatically inspectable hallmarks provide information concerning the authenticity of the information carrier even in automatic inspection devices.

For instance, if the color layer 4 shown in FIG. 1 contains fluorescent additives, areas 2 will be able to be recognized when suitable excited in an automatic inspection device due to their characteristic fluorescence. Since the remaining areas of the layer 4 are covered by color layers 1 and 3, no fluorescence will be discovered in these concealed areas, at least not from the front side. If a transparent substrate T is used, in which the optical access to layer 4 is not impeded by other prints or laminations, the same fluorescence will be able to be inspected on the entire rear surface in an inspection instrument.

Irrespective of whether the optical pattern is used in multilayer laminates or in non-laminated monolayer information carriers, any attempts to manipulate the identification card will disrupt and damage the predetermined structure of the fluorescent or non-fluorescent areas in any case so that the layer structure will indicate such tampering either by additional fluorescing areas on the front side, caused by ruptures in layers 1 and/or 3, or by impairment of the homogeneous fluorescence on the rear side, caused by damage to layer 4.

If a plurality of different fluorescent substances or other different material properties which can be identified by machine is employed, this can do as much to enhance the reliability against forgery or counterfeiting as the use of more complicated patterns and layer structures. The illustrated examples can be varied and modified as desired as far as the layer thickness, number of layers, colors, inks, shape and organization of the surface areas are concerned.

What is claimed is:

1. An identification card adapted to be authenticated by transmitted and reflected light comprising a sheet-like substrate of substantially homogeneous color having applied thereto a hallmark comprising partially overlapping layers of colors whereby the quantity of light transmitted through the overlapping areas of the color layers is less than the quantity of light transmitted through the nonoverlapping areas so that the overlapping areas appear darker to the eye than the nonoverlapping areas when light is transmitted therethrough, and whereby light reflected from the overlapping areas visually possesses greater color intensity than the surrounding.

2. An identification card adapted to be authenticated by transmitted and reflected light comprising a sheet-like substrate having applied thereto partially overlapping layers of colors; said substrate and the color layers being light-pervious; said substrate also being of substantially uniform color throughout; the overlapping areas of said color layers comprising a hallmark whereby the quantity of light transmitted through the overlapping areas of said color layers is less than the quantity of light transmitted through the nonoverlapping areas so that the overlapping areas appear darker to the eye than the nonoverlapping areas when light is transmitted therethrough, and whereby light reflected from the overlapping areas of said color layers visually imparts greater color intensity than the surrounding.

3. A plastic card adapted to be authenticated by hallmarks; said hallmarks being adapted to have light transmitted therethrough and light reflected therefrom; said card comprising a plastic sheet-like substrate; a first color layer printed on at least a portion of said substrate; a second color layer printed in partially overlapping relation with said first layer, said substrate and the overlapping areas of said color layers being pervious to light; the overlapping areas comprising a hallmark whereby said overlapping areas appear darker than the nonoverlapping areas when a quantity of light is transmitted through said overlapping and nonoverlapping areas; said colored layers having greater color intensity in the overlapping areas than the surrounding when viewed in reflected light.

4. A card according to claim 1, 2 or 3 wherein the first color layer applied to said substrate has masked out therefrom in the course of application to said substrate an area which appears brighter than the remainder of said first color layer when a quantity of light is transmitted through said card, and said card is in combination with at least one other coating layer which is in registration with and overlies said first and second layers at least in the overlapping areas thereof.

5. A card adapted to be authenticated by hallmarks therein, comprising a light-transmitting, substantially-planar substrate; a first layer of substantially uniform color disposed on a portion of one planar surface of said substrate; a hallmark comprising a discontinuity in said first color layer and outlined by said first color layer; a second color layer defining said hallmark of said first layer in partially overlapping relation with said first layer and in partial overlapping relation with the hallmark discontinuity therein; said color layers appearing darker in the overlapping areas than the nonoverlapping areas when a quantity of light is transmitted through said overlapping and nonoverlapping areas; said colored layers having greater color intensity in the overlapping areas than the surrounding when viewed in reflected light.

6. A process for producing an identification card comprising coating a light permeable substrate sheet with a light permeable color layer, said layer having an opening therein comprising a hallmark; coating said substrate with a second light permeable color layer defining substantially said hallmark and arranged in partially overlapping relationship with the opening of said first coating.

7. The process of claim 6 in which said substrate has a homogeneous color layer applied thereto prior to application of the first color layer.

8. The process of claim 6 in which the color layers are applied by a technique selected from the group consisting of silk screening, offset printing and letterpress printing.

9. A card according to claims 1, 2 or 3 wherein the substrate is a transparent plastic sheet whose entire area is printed with a homogeneous color layer prior to application of said first and second color layers.

10. A card according to claims 1, 2 or 3 wherein the substrate is a plastic sheet of homogeneous color.

11. A card according to claims 1, or 2, wherein at least one color layer is provided per brightness level in transmitted light.

12. A card according to claims 1, or 2, wherein at least n - 1 color layers are provided in case of n brightness levels in transmitted light.

13. A card according to claims 1, 2, 3, or 5 wherein the color layers are of differing thicknesses in order to achieve different brightness levels in transmitted light.

14. A card according to claims 1, 2, 3 or 5 wherein the concentration of the colorant in the color layers varies in order to achieve different brightness levels in transmitted light.

15. A card according to claims 1, 2, 3 or 5 wherein all color layers are white.

16. A card according to claims 1, 2, 3 or 5 wherein one color layer is colored differently from another layer.

17. A card according to claims 1, 2, 3 or 5 wherein colorants are used in said layers which have special physical properties such as fluorescence, spectral absorption or the like.

18. A card according to claims 1, 2, 3 or 5 in combination with an uppermost color layer which covers the entire substrate.

* * * * *